US007959518B1

(12) United States Patent
Finley

(10) Patent No.: US 7,959,518 B1
(45) Date of Patent: Jun. 14, 2011

(54) GOLF TRAINING DEVICE AND HAND PLACEMENT GAUGING TOOL

(75) Inventor: Robbie Jay Finley, Longmont, CO (US)

(73) Assignee: Robbie Jay Finley, Longmont, CO (US)

( * ) Notice: Subject to any disclaimer, the term of this patent is extended or adjusted under 35 U.S.C. 154(b) by 0 days.

(21) Appl. No.: 12/653,995

(22) Filed: Dec. 22, 2009

(51) Int. Cl.
*A63B 69/36* (2006.01)

(52) U.S. Cl. ..... 473/206; 473/201; 473/227; 473/409

(58) Field of Classification Search ..... 473/201, 473/206, 212, 213, 219, 226, 227, 228, 257, 473/266, 268, 409
See application file for complete search history.

(56) References Cited

U.S. PATENT DOCUMENTS

| | | | | |
|---|---|---|---|---|
| 4,170,356 | A * | 10/1979 | Banks | 473/227 |
| 5,524,892 | A * | 6/1996 | Karp | 473/206 |
| 6,004,221 | A * | 12/1999 | Thornhill | 473/227 |
| 6,656,056 | B1 * | 12/2003 | Leonard | 473/227 |
| 2005/0202896 | A1 * | 9/2005 | Burke | 473/276 |

* cited by examiner

*Primary Examiner* — Nini Legesse

(57) ABSTRACT

One embodiment of a golf training aid that provides a visual and physical reference as to the correlational relationship between a golfers' hand-placement on a golf club and the face of the golf club at impact to provide means for the golfer to hit a straight golf shot or to shape a golf shot. Utilizing a rear sight guide (10) and a front sight (14) attached to an alignment guide rail (12) and a flexible joint or hinge (16), the gauging apparatus provides physical reference for the golfers' hand-placement and a visual reference to desired target lines. Other embodiments are described and shown.

2 Claims, 6 Drawing Sheets

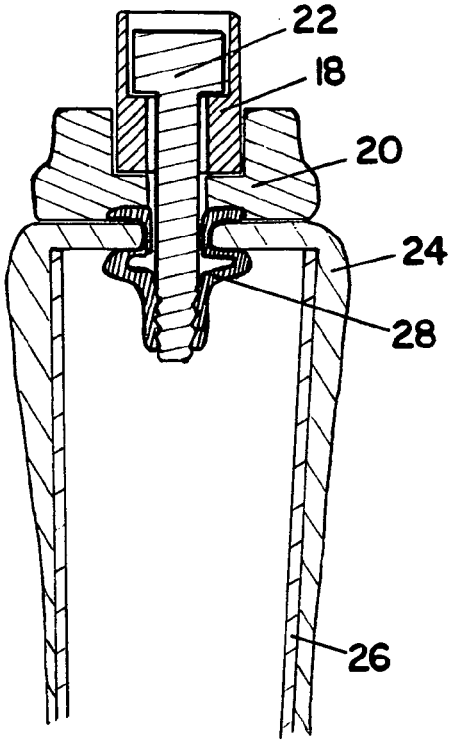
FIG.9
FIG.10
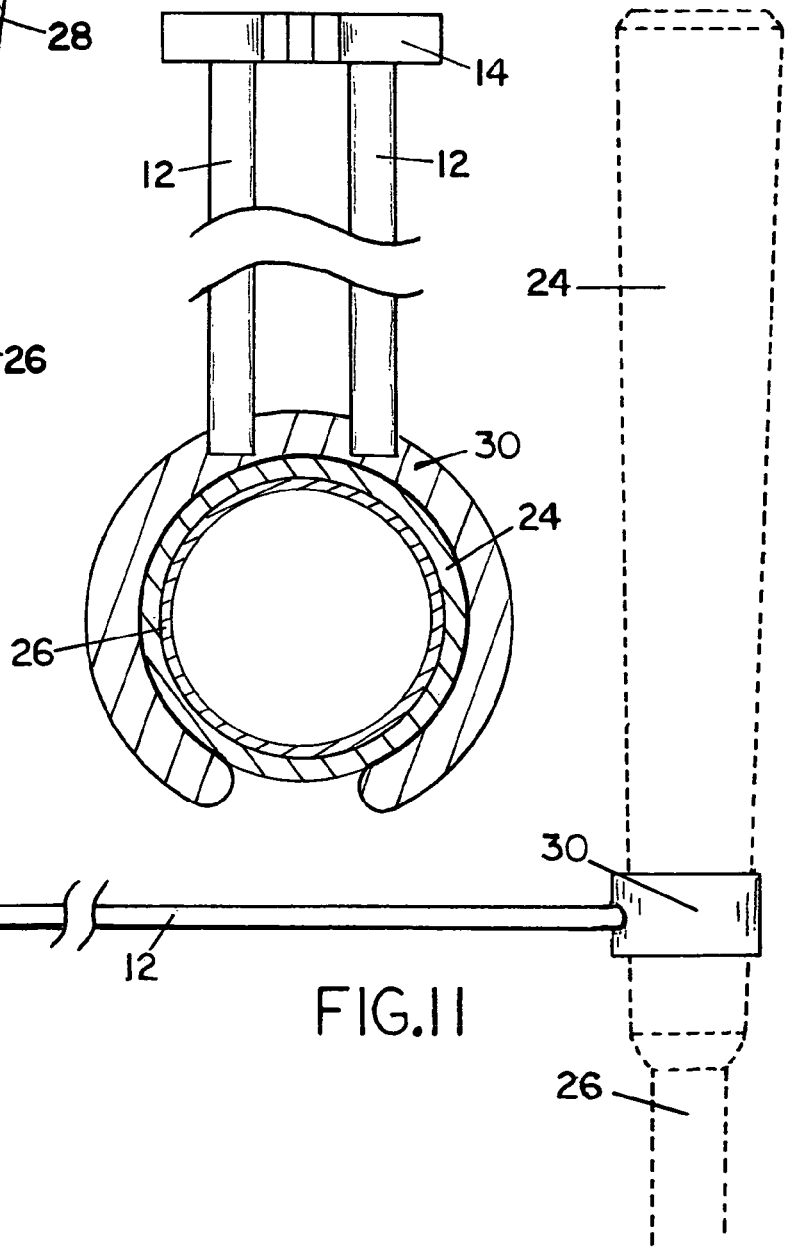
FIG.11

GOLF TRAINING DEVICE AND HAND PLACEMENT GAUGING TOOL

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND-FIELD

This application relates to golf training aids, specifically a gauge for hand placement for ball shot correction and/or shaping.

BACKGROUND-PRIOR ART

A various number of golf related teaching aids and devices have been introduced and implemented in an attempt to aid the golfer in hitting a golf ball to a desired target. While stance, grip, and swing plane are important to a golfers swing, the ultimate goal for the golfer is to get the clubface square to the target at impact. In essence, if the face of the club is square to the target at impact, the ball will finish in the direction of the target, regardless of traditionally correct (or traditionally incorrect) style of grip, stance, swing plane, or any combination of the three.

The golf related training aids on the market today do not take into account the ultimate ability of most golfers. Rather, these aids promote an unreal expectation of what is considered perfection at a professional level. Millions of golfer around the world will never achieve a perfect swing.

It is a common misconception in the modern teaching of golf that there is only one correct way to stand, swing, and grip a golf club. This teaching, unfortunately, frustrates the majority of golfers, be they new to the game or seasoned players. They become frustrated because there are too many components to know, learn, and then remember and implement. Even the most diligent of golfer will experience changes in their shot making on a day to day basis.

Players with physical limitations or disabilities, too, are expected to conform to what is considered the only correct way to hit a golf ball. In fact, their disabilities may preclude them from ever being able to hit a golf ball in the manner that is considered the only correct method.

Several types of golf training aids were designed in such a way as to educate the golfer in a correct manner for gripping a golf club. U.S. Pat. No. 6,022,028 to Vela (2000), U.S. Pat. No. 5,984,795 to Stafford (1999), U.S. Pat. No. 6,210,289 to LaBrake (2001), U.S. Pat. No. 6,705,951 to Beauregard (2004), U.S. Pat. No. 6,540,621 to Robinson (2003), U.S. Pat. No. 5,398,930 to Gibson (1995), all disclose their respective attachment to a golf club that would indicate what is considered in the field as a 'proper' positioning of the hands on the grip. While these inventions fulfill their respective objectives and disciplines, they are only beneficial if the golfer hits the desired shot with what is referred to as 'proper' grip. If the golfer is still hitting errant golf shots, the golfer needs to look for another training aid to fix their proper grip. Again, because the assumption is that there is only one proper grip style, the golfer is asked to conform to this 'one size fits all' mentality.

Several types of golf training aids have been designed to educate a golfer on proper aiming and alignment of the golfer himself and the golf shot. U.S. Pat. No. 7,527,562 to Mason (2009), U.S. Pat. No. 7,081,054 to Nikkel (2006), U.S. Pat. No. 6,912,802 to Cooper (2005), U.S. Pat. No. 6,669,575 to Marlette (2003), are all examples of systems and methods for what is considered proper aiming and alignment of either the golfer, the golf shot and/or both. They are only effective methods if everything else in a golfer's swing is correct and proper. As many golfers will attest, this is rarely the case.

None of the above mentioned patents/inventions, whether viewed in combination or individually, allows for the inabilities of the large majority of golfers to immediately enjoy the game of golf. They all rigidly assume that there is but one correct method for each of their respective disciplines of golf. Thus, the need remains for a golf training aid that will make only a minor adjustment for a golfer that will allow that golfer to hit a golf ball to a desired target, regardless of what has been deemed traditionally incorrect. This enables the golfer to play the game as proficiently as that golfer's abilities will allow. Also, as the golfer becomes more adept at the nuances of the game, it is desirable for a training device that will continue to benefit the golfer, regardless of what ability level is ultimately achieved.

SUMMARY

In accordance with the embodiments, the present apparatus provides gauged feedback for the relationship between the clubface of a golf club at impact and the individual golfers' hand placement at impact. This relationship will define proper grip alignment for the individual golfer and not necessarily what is considered to be traditionally correct or proper.

This gauging apparatus defines desired grip position for correction of errant golf ball flight as well as the shaping of golf shots to a desired target line. The shaping of a golf shot is as desirable as a straight golf shot, should the golfer desire to avoid a hazard(s) or other interference along their intended target line.

DRAWINGS

Figures

FIG. 9 shows the apparatus attached to a golf club utilizing an internal method of attachment to a golf club, in accordance with one embodiment of the apparatus.

FIG. 10 and FIG. 11 show the apparatus attached to a golf club utilizing an external method of attachment to a golf club, in accordance with another embodiment of the apparatus

Figure 1:
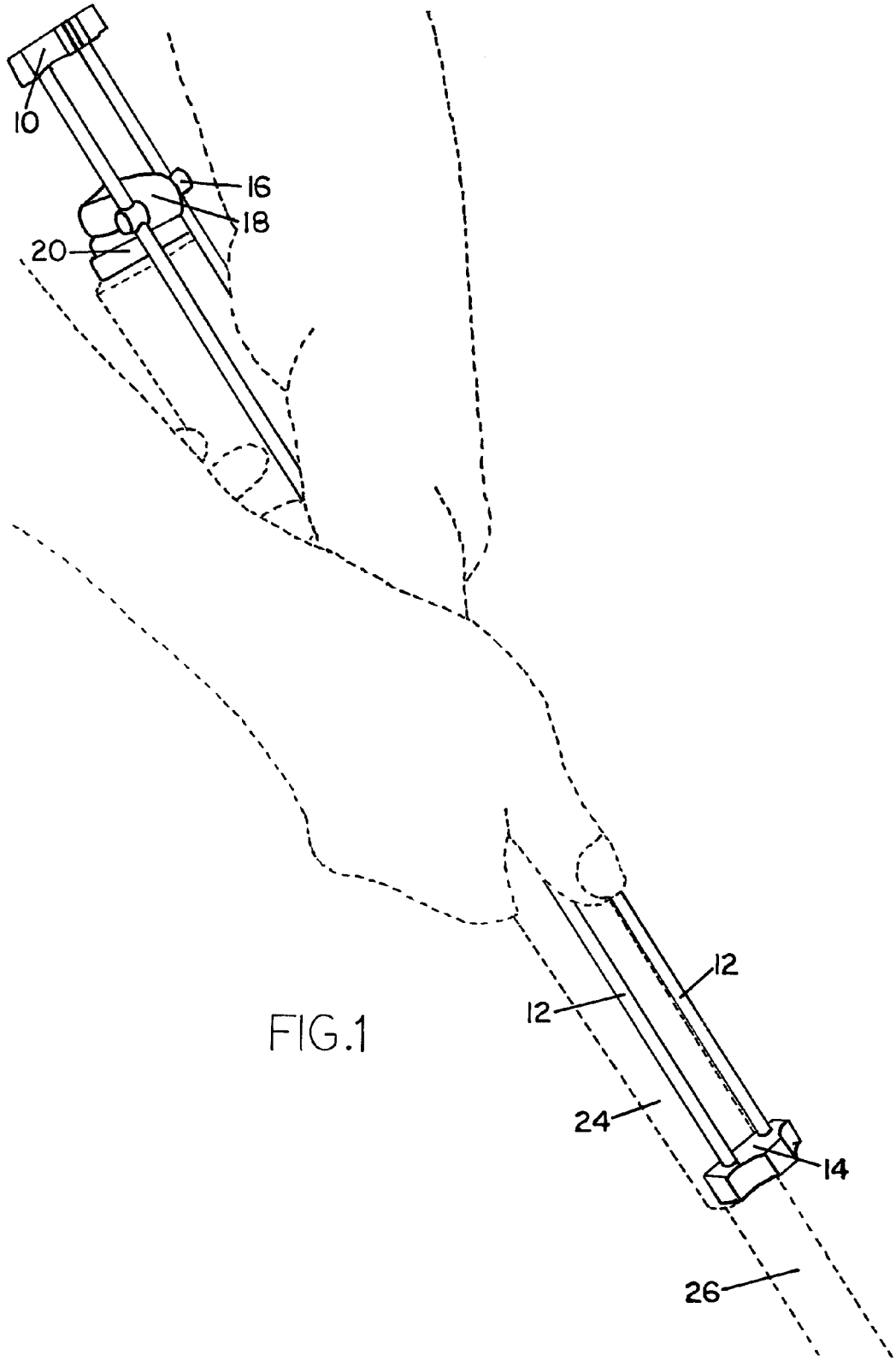
FIG. 1 shows the apparatus attached to a golf club (in parallel position to the golf shaft/grip) and the relationship between the golfer's hand placement and the apparatus, in accordance with one embodiment of the apparatus.

| DRAWINGS-(Reference Numerals) | | | |
|---|---|---|---|
| 10- | rear sight guide | 12- | alignment guide rail |
| 14- | front sight | 16- | hinge |
| 18- | sliding hinge base | 20- | centering base |
| 22- | centering pin | 24- | golf grip |
| 26- | golf shaft | 28- | expansion nut |
| 30- | clamp | | |

REFERENCE LETTERS

FIG. 5 and FIG. 6

A—optimal target line

B—errant ball line at completion of flight (with hand placement in position C)

C—golfers' hand placement (resulting in the errant shot to point B)

D—hand placement change required to hit the ball straight (to target line A)

X—correlational relationship of A&B to C&D (gauged degree of relationship)

DETAILED DESCRIPTION

Figure 2:
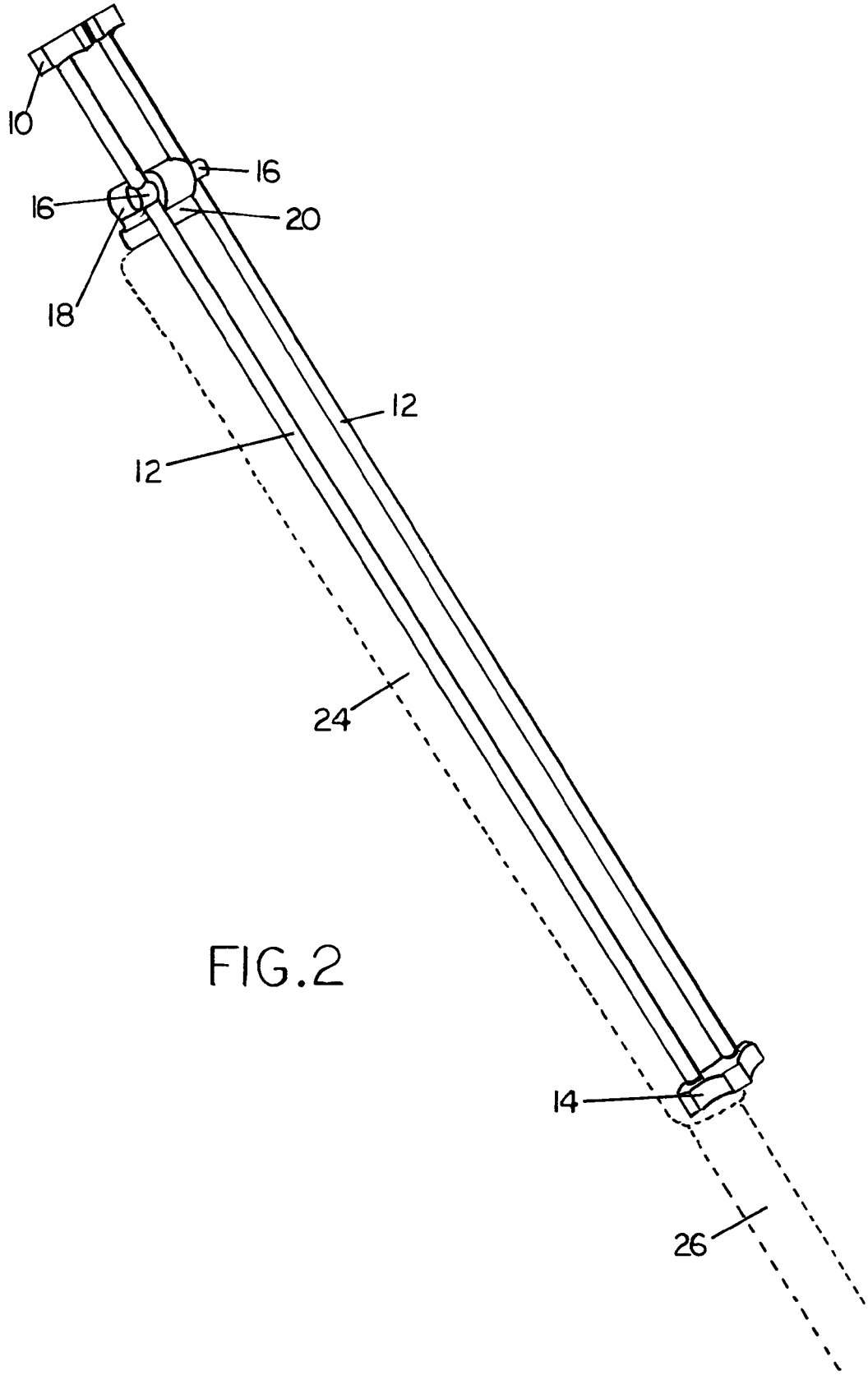
FIG. 2 shows the apparatus attached to a golf club (in parallel position to the golf shaft/grip), in accordance with one embodiment of the apparatus.
Figure 3:
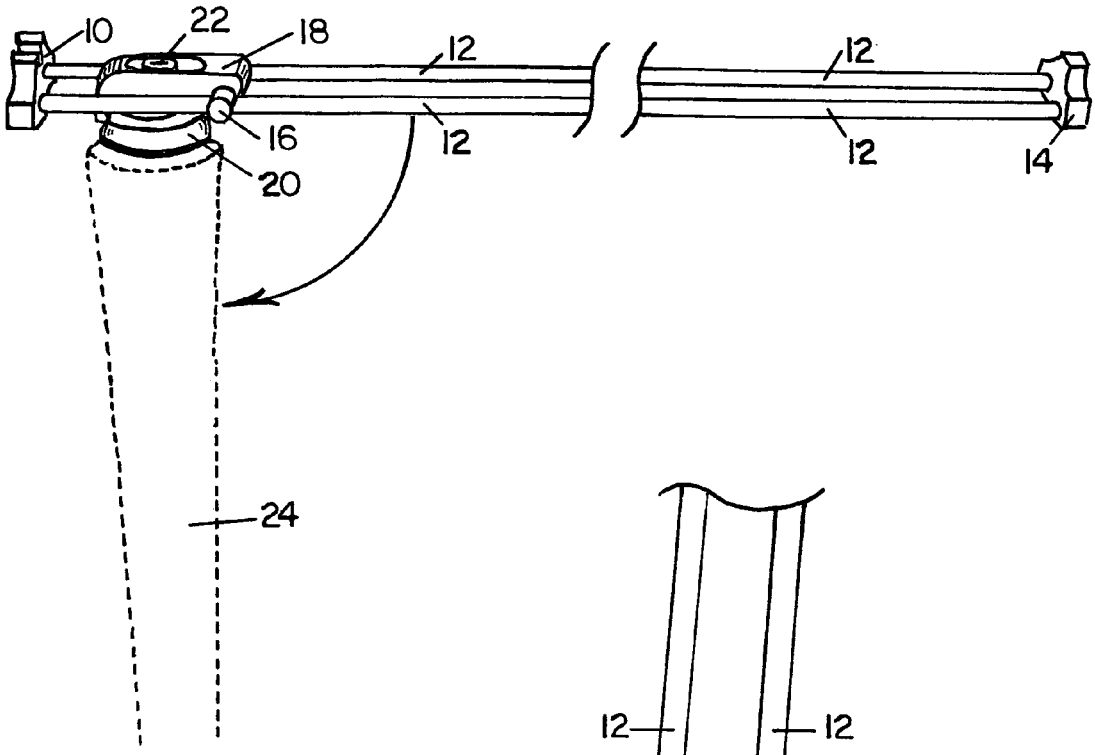
FIG. 3 and FIG. 4 show the apparatus attached to a golf club (in the perpendicular position to the golf club shaft/grip), in accordance with one embodiment of the apparatus.
Figure 4:
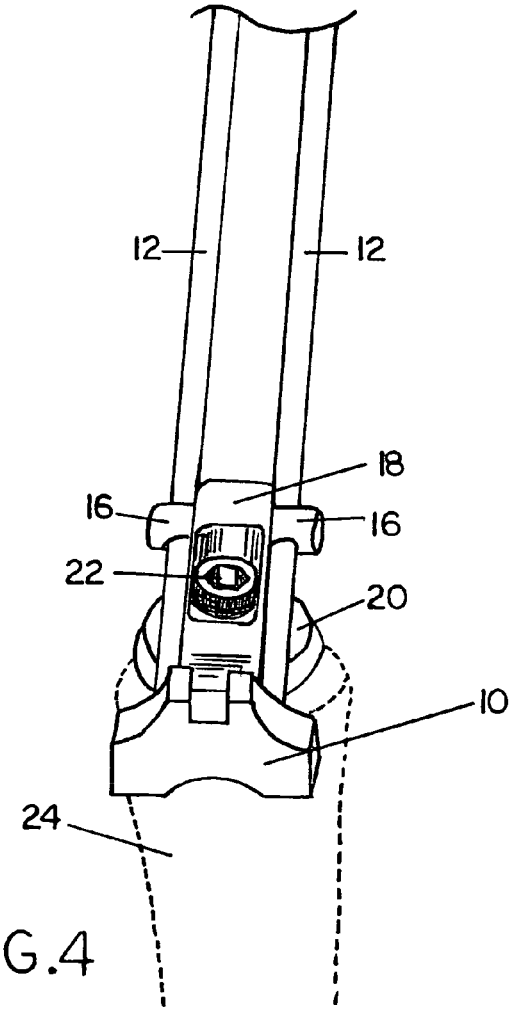

FIGS. 1 and 2 illustrate perspective views of one embodiment of the apparatus and its attachment to a golf club. FIG. 1 further illustrates the golfers' hands in relationship to the golf club and apparatus. A golf grip 24 and a golf shaft 26 are included in the illustration of FIGS. 1 and 2 for clarity. The apparatus has a rear sight guide 10 and a front sight 14 to demarcate the golfers' hand placement alignment when the apparatus is in a parallel position to the golf club. In its parallel position, the apparatus aligns the golfers hand placement for a gauged reference point. The golfers' hand placement is guided and indicated with one or more alignment guide rails 12. The alignment guide rails are connected to a hinge 16 that allows the alignment guide rails 12 and the rear sight guide 10 and the front sight 14 to be positioned in either a parallel position or a perpendicular position to the golf club. The hinge 16 is attached to an adjustable sliding hinge base 18 for attachment to golf grips and golf clubs of varying diameters. The sliding hinge base 18 is connected to a centering base 20. The centering base 20 aligns the apparatus to the center axis of the golf club. I contemplate this gauging apparatus be made of a lightweight metal such as aluminum or titanium, however, other strong and lightweight materials are suitable.

Figure 5:
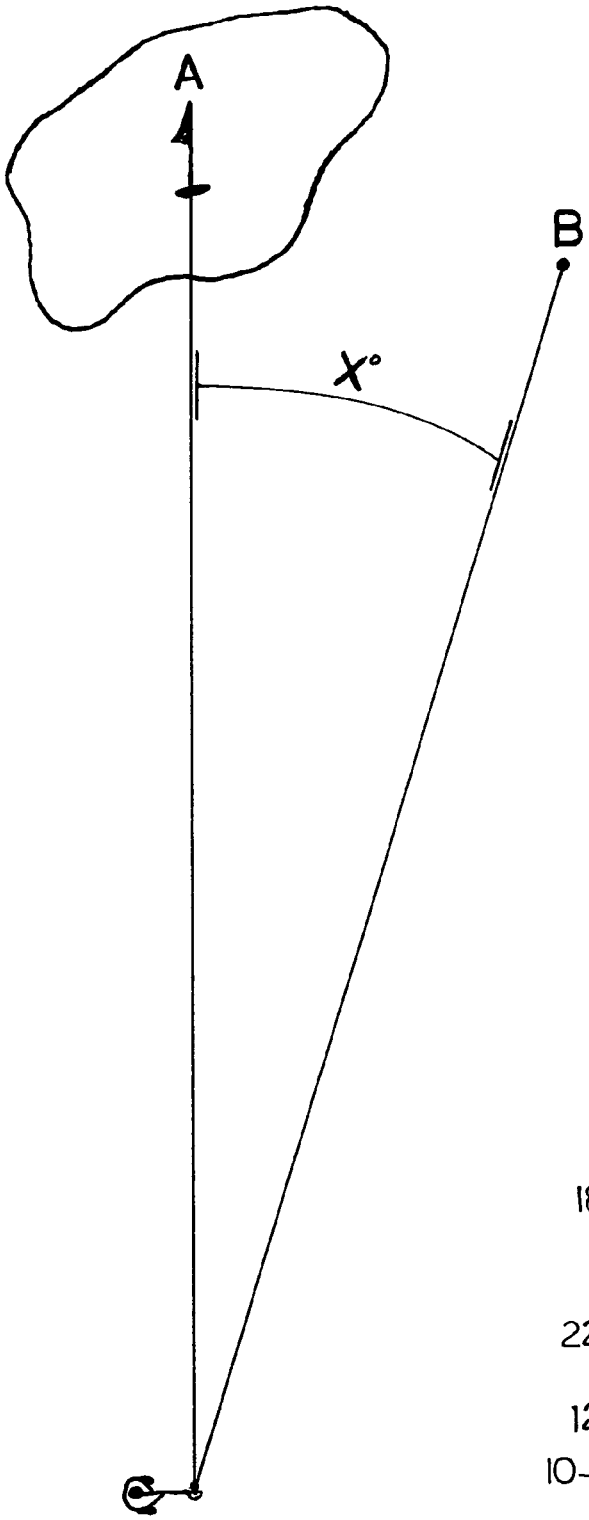
FIG. 5 and FIG. 6 show the relationship between target line & ball at finish vs. initial grip placement & grip placement correction required for the golfer to hit the golf ball to the desired target line.

FIGS. 3, 4, 5, 6, 7, 8 illustrate the apparatus in its raised or perpendicular position to the golf club. In this position the golfer can align the apparatus from an initial demarcation of hand placement C (in parallel position) to an optimal target line 'A', (FIG. 5), as well as move the apparatus to an 'errant ball line at completion of flight' B, (FIG. 5). From this perpendicular position the apparatus is then returned to the parallel position to define corrected hand placement for a straight golf shot.

Figure 6:
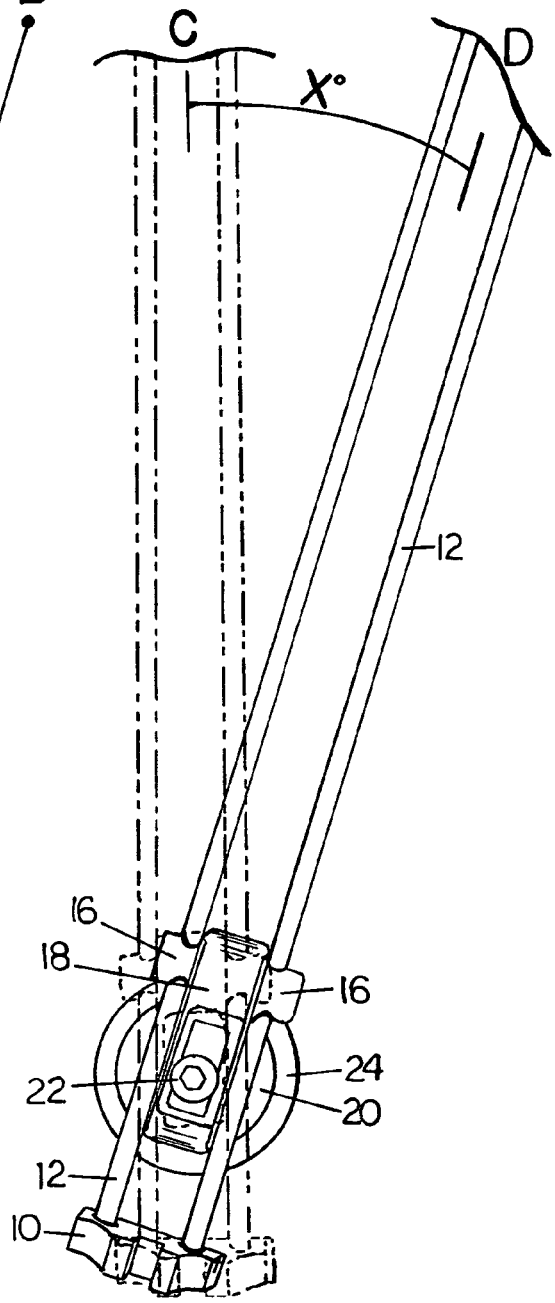

FIGS. 5 and 6 illustrate a correlational relationship X between the target line A & an errant ball line at completion of flight B to the golfers' hand placement (resulting in the errant shot to point B) C & a hand placement change required to hit the ball straight (to target line A) D.

Figure 7:
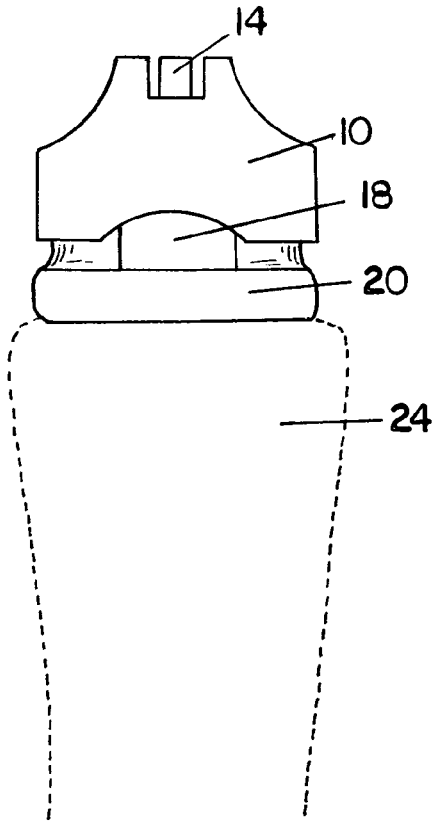
FIG. 7 shows the apparatus attached to a golf club, in accordance with one embodiment of the apparatus.

FIG. 7 illustrates the view from the rear of the apparatus in its attached position to a club. In this embodiment the apparatus is attached in the golf grip 24. In this embodiment, the front sight 14 is visible between the earlike members of the rear sight 10 to aid the golfer in aiming the apparatus to the intended target line A and pointing to the errant ball line at completion of flight (with hand placement in position C) B.

Figure 8:
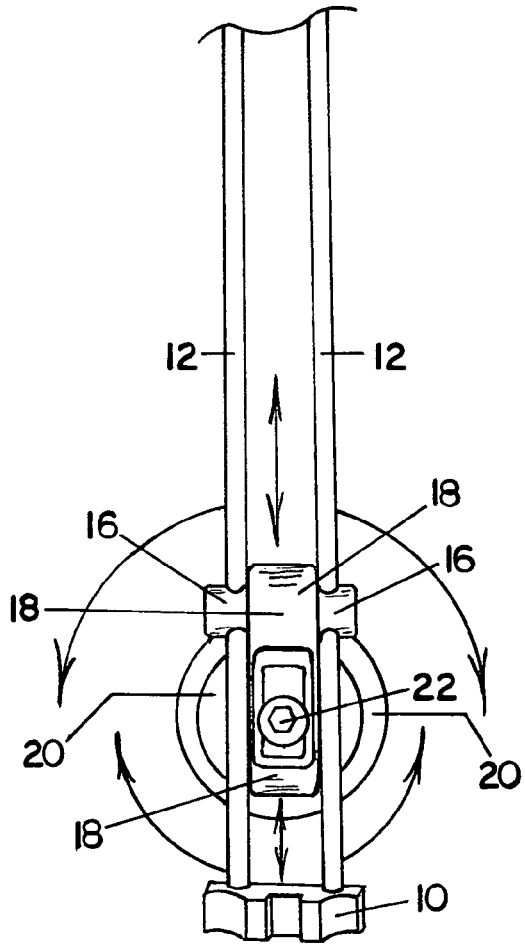
FIG. 8 shows the apparatus attached to a golf club (in the perpendicular position to the golf club/shaft) with rotational and sizing capability, in accordance with one embodiment of the apparatus.

FIG. 8 illustrates the 360 degree movement capability of the apparatus around the centering pin 22, as well as the movement of the sliding hinge base 18 which allows the apparatus the ability to adjust to different diameters of golf clubs and grip sizes.

FIG. 9 illustrates an internal method for attachment of the apparatus to a golf club. One embodiment of the apparatus is attached internally to a golf club with an expansion nut 28 or other similar well nut type fastener. The expansion nut 28 may be such that it expands to the internal wall of the shaft or to the bottom of the interior, of the golf grip. The foregoing should be considered illustrative of the presented embodiment, though other methods of attachment are available and well known.

FIGS. 10 and 11 illustrate another embodiment depicting an external means for attachment to a golf club. With the use of a clamp 30 the apparatus is illustrated in a perpendicular position that allows for placement along the length of the golf club. For external attachment the expansion nut 28 is not included. The centering base 20, the sliding hinge base 18, and the centering pin 22 may be otherwise incorporated into the clamp 30. The foregoing should be considered illustrative of the presented embodiment, though other methods of attachment are available and well known.

Operation

With the gauging apparatus attached to the golf club as illustrated in FIG. 2 the golfer takes hold of the golf club grip as illustrated in FIG. 1. The golfer would take what as is their particular style or custom for gripping a golf club. Using the alignment guide rails to align some notable portion of their hand placement as in FIG. 1 (for reference purposes FIG. 1 illustrates the golfers' thumbs both being aligned between the alignment guide rails 12, in what may be considered a traditionally incorrect hand-placement) the golfer would hit singular or multiple golf shots to make note as to the location of errant ball line at completion of flight B.

The golfer would then hold the golf club in a vertical position. raising the gauging apparatus up to a perpendicular position to the golf club as illustrated in FIGS. 3, 4, 6, 7, 8, the golfer would align the front sight 14 with the rear sight guide 10 so as to align or aim the apparatus to the optimal target line A. Next, the golfer (while keeping the golf club steady) would turn the gauging apparatus so as to point the apparatus to the errant ball line at completion of flight B.

The golfer would then unhinge or drop the hinged portion of the apparatus, to include the front sight 14, the rear alignment sight 10, and the alignment guide rails 12 back to parallel along the golf club. At this point the golfer would take their adjusted grip on the golf club keeping the same grip they used in relationship to the apparatus (not the club) in a new position on the golf club grip. All things being equal, their clubface will be square at impact with their gauge adjusted grip placement on their next golf shot or ensuing golf shots. This correlational relationship is best illustrated in FIGS. 5 and 6.

In FIG. 5 a representation of a golfer is shown with an optimal target line A as illustrated to the center of a golf green. The errant ball line at completion of ball flight (with hand placement in position C) B is illustrated and representative of where the golfers' shot(s) finished at the end of their flight, regardless of ball flight to that completed flight, be it right to left, left to right, or straight.

In FIG. 6 the golfers' hand placement (resulting in the errant shot to point B) C is illustrated with the apparatus in its perpendicular stage and the hand placement change required to hit the ball straight (to target line A) D. FIGS. 5 and 6 also illustrate the correlational relationship of A&B to C&D X.

Conversely, once the golfer understands the correlational relationship of A&B to C&D X, and thus, has defined a neutral hand positioning for their particular style of hand placement, they are able to utilize the gauging apparatus to shape shots. For example (referring to FIGS. 5 and 6), from the golfers' defined neutral position, they wish to hit a golf ball to an optimal target line A, however, there is an obstacle along this line that loft alone would not avoid, thus requiring a shaped shot.

For illustration purposes let's say the golfer has had more success in hitting a designed fade rather than a right to left ball flight (assuming, for illustration purposes, the golfer in this example is right-handed). To utilize the gauging apparatus the golfer places the apparatus in the neutral position the golfer has defined for their individual hand placement or style in parallel position to the club. Once positioned the golfer would raise the apparatus to its perpendicular position in relationship to the club.

The golfer would hold the golf club in a vertical position and aim or align the apparatus to the optimal target line A ("That is where I want my ball to finish"). Then, holding the golf club steady and in a vertical position the golfer would rotate the gauging apparatus (still keeping the golf club stationary) to a point left of the obstacle that would avoid the obstacle ("That is where I will start the initial ball flight").

Next, the golfer would align their shot stance as they normally would as if they were merely hitting a shot to the left of the obstacle. The idea here is that we want no other changes in the golfers' set up or swing. If their hand placement was in their defined neutral placement, the ball would carry straight past the obstacle on the left of the obstacle without variance of ball flight. Because the golfer chose to shape the shot from left to right, the ball will start left of the obstacle, but, because the golfer gauged the degree as to how much to open the clubface at impact, the ball will finish (left to right) toward the optimal target line A.

FIG. 10 and FIG. 11—Alternative Embodiments

There are various possibilities with regard to attachment to a golf club. Internal expansion-type devices are well known as well as c-clamp-type devices that are readily available and can be fashioned so as to attach externally to a golf club shaft 26 or golf grip 24. FIG. 10 and FIG. 11 depict such a type of fastening device or clamp 30.

FIG. 11 illustrates another embodiment of a gauging apparatus for a golfers hand placement to either hit a golf ball straight or to shape a golf shot. It is easy to see that a hinging mechanism can be attached to a clamp 30 such as in FIG. 11 so as to permit the gauge to hinge upright and parallel to the golf club and still fall within the intent of the initial embodiment. FIG. 11 is an illustration of the gauging apparatus merely reduced to a simpler form. The alignment guide rail 12 may be singular or plural.

Advantages

From the description above, a number of advantages of some embodiments of my gauging apparatus become evident:

a) A golf training aid that does not require a golfer to be what is considered traditionally correct to play and enjoy the game of golf.

b) A golf training aid that will provide immediate feedback as to the relationship between a golfers' hand-placement and the golf club clubface at impact, as well as an immediate remedy for fixing errant golf shots.

c) A tool that will accurately gauge a desired shaped shot without having to resort to multiple attempts with an antiquated method of 'trial and error', or a number of other swing changes to effect the desired shot.

CONCLUSION, RAMIFICATIONS, AND SCOPE

Accordingly, the reader will see that the golf training aid, a gauging apparatus, of the embodiments herein mentioned can be utilized to improve a golfers game by gauging the correction required in a golfers' hand placement resulting in the elimination of errant golf shots and the inclusion of the ability to shape a desired golf shot. This correction may or may not correct the golfers' hand placement to what is considered traditionally correct, rather and more importantly, it will correct the hand placement to a position of correctness for the individual golfer to hit a golf ball to a desired target line.

Although the description and illustrations provided herein contains much specificity, these should not be construed as limiting in scope of the embodiments but as merely providing illustrations of some of the presently preferred embodiments. For example, the rear sight guide and front sight may be designed differently, without loss of intended function. The alignment guide rails, whether in singular or plural form, may be so fashioned so as to receive a golfers' hand placement with a different design or pattern without loss of intended function. A design change to the hinge of the apparatus may be changed without loss of intended function or eliminated if the golfer so desires only a visual reference for their hand placement and not a physical reference in contact with their particular grip. The sliding hinge base may be eliminated if the apparatus is designed so as to fit a predetermined sized grip or without concern for adjustment to other sizes of grips. This could lead to a change in the centering pin and the centering base, as well, without loss of intended function. A golf shaft or grip may be so designed so as to receive the gauging apparatus, eliminating modular or sectional portions of the gauging apparatus without loss if intended function of the gauging apparatus itself.

Thus, the scope of the embodiments should be determined by the appended claims and their legal equivalent, rather than by the examples given.

I claim:

1. A method for aiding a golfer to correct a persistent errant golf ball flight, said golfer having a customary grip for holding a golf club, said golf club having a clubhead, a shaft extending from said clubhead and into a handle for gripping by the golfer, comprising the steps of:

providing a training tool including:

a base;

means for rotatably mounting said base onto said handle;

at least one guide rail extending from said base;

a hinge at the base end of said guide rail, said hinge allowing said guide rail to be selectively moved between a position parallel to said shaft and a position perpendicular to said shaft;

means for aiming said guide rail in a selected direction relative to said errant golf ball flight;

positioning the guide rail parallel to the shaft;

the golfer gripping the club using his customary grip, resulting in an original position of his hands relative to the guide rail;

the golfer hitting at least one shot to identify the ending location of said errant ball flight;

raising the shaft to a vertical position;

hinging the guide rail into a position perpendicular to the shaft;

rotating the base so that the guide rail is aimed at said ending location;

hinging the guide rail back into a position parallel to the shaft; and the golfer gripping the club with his hands in their original position relative to the guide rail, thereby adjusting his grip to aid in correcting the errant ball flight.

2. A training tool for aiding a golfer to correct a persistent errant golf ball flight, said golfer having a customary grip for holding a golf club, said golf club having a clubhead, a shaft extending from said clubhead and into a handle for gripping by the golfer, comprising:

a base;

means for rotatably mounting said base onto said handle;

at least one guide rail extending from said base;

a hinge at the base end of said guide rail, said hinge allowing said guide rail to be selectively moved between a position parallel to said shaft and a position perpendicular to said shaft;

means for aiming said guide rail in a selected direction relative to said errant golf ball flight; and wherein the persistent errant ball flight is corrected by:

positioning the guide rail parallel to the shaft, the golfer gripping the club using his customary grip, resulting in an original position of his hands relative to the guide rail, the golfer hitting at least one shot to identify the ending location of said errant ball flight, raising the shaft to a vertical position, hinging the guide rail into a position perpendicular to the shaft, rotating the base so that the guide rail is aimed at said ending location, hinging the guide rail back into a position parallel to the shaft, and the golfer gripping the club with his hands in their original position relative to the guide rail, thereby adjusting his grip to aid in correcting the errant ball flight.

* * * * *